US009538598B2

(12) United States Patent
Zhang

(10) Patent No.: US 9,538,598 B2
(45) Date of Patent: Jan. 3, 2017

(54) BACKLIGHT ADJUSTMENT CIRCUIT AND ELECTRONIC DEVICE

(71) Applicant: SHENZHEN CHINA STAR OPTOELECTRONICS TECHNOLOGY CO., LTD., Shenzhen, Guangdong (CN)

(72) Inventor: Xianming Zhang, Guangdong (CN)

(73) Assignee: SHENZHEN CHINA STAR OPTOELECTRONICS TECHNOLOGY CO., LTD, Shenzhen (CN)

( * ) Notice: Subject to any disclaimer, the term of this patent is extended or adjusted under 35 U.S.C. 154(b) by 0 days.

(21) Appl. No.: 14/370,233

(22) PCT Filed: Jan. 17, 2014

(86) PCT No.: PCT/CN2014/070834

§ 371 (c)(1),
(2) Date: Jul. 2, 2014

(87) PCT Pub. No.: WO2015/089928

PCT Pub. Date: Jun. 25, 2015

(65) Prior Publication Data

US 2016/0302278 A1 Oct. 13, 2016

(30) Foreign Application Priority Data

Dec. 19, 2013 (CN) ..... 2013 1 0706516

(51) Int. Cl.
*H05B 33/08* (2006.01)

(52) U.S. Cl.
CPC ..... *H05B 33/0851* (2013.01); *H05B 33/086* (2013.01); *H05B 33/0812* (2013.01); *H05B 33/0845* (2013.01)

(58) Field of Classification Search
USPC ..... 315/247, 224, 225, 185 S, 307–326, 291
See application file for complete search history.

(56) References Cited

U.S. PATENT DOCUMENTS 8,890,417 B2 * 11/2014 Hu ..... H05B 33/0851 315/122
2005/0128376 A1 6/2005 Li et al.
(Continued)

FOREIGN PATENT DOCUMENTS

CN 1956612 A 5/2007
CN 201170540 Y 12/2008
(Continued)

OTHER PUBLICATIONS

Yanqin Li, the International Searching Authority written comments, Sep. 2014, CN.

*Primary Examiner* — Tuyet Vo

(57) ABSTRACT

An backlight adjustment circuit (20), configured to adjust luminance of light emitted by one light-emitting diode (LED) string (11) of a LED module (10), the LED string (11) includes a plurality of LEDs (D) and a current control resistor (R). The backlight adjustment circuit (20) includes a light sensing circuit (21) for sensing the luminance of one corresponding LED string (11) and producing a corresponding light sensing signal value; a comparison unit (22) for comparing the light sensing signal value with a preset reference value, and producing a first signal when comparing the light sensing signal value is less than the preset reference value, else producing a second signal; and an adjustment unit (23) for decreasing the luminance of the LED string (11) when receiving the first signal and increasing the luminance of the LED string (11) when receiving the second signal.

16 Claims, 2 Drawing Sheets

(56) References Cited

U.S. PATENT DOCUMENTS

| | | | | |
|---|---|---|---|---|
| 2010/0045187 | A1* | 2/2010 | Shteynberg | H02M 3/157 315/149 |
| 2011/0109245 | A1* | 5/2011 | Lin | H05B 33/0815 315/294 |
| 2012/0146546 | A1 | 6/2012 | Hu et al. | |
| 2012/0217890 | A1* | 8/2012 | Chang | H05B 33/0815 315/224 |

FOREIGN PATENT DOCUMENTS

| | | | |
|---|---|---|---|
| CN | 201387449 | Y | 1/2010 |
| CN | 102045916 | A | 5/2011 |
| CN | 102105005 | A | 6/2011 |
| CN | 102708809 | A | 10/2012 |
| CN | 103198799 | A | 7/2013 |
| KR | 10-2007-0024235 | A | 3/2007 |
| TW | 200639516 | A | 11/2006 |

* cited by examiner

BACKLIGHT ADJUSTMENT CIRCUIT AND ELECTRONIC DEVICE

FIELD OF THE INVENTION

The present invention relates to adjustment circuits, and more particularly, to a backlight adjustment circuit and an electronic device with the backlight adjustment circuit.

BACKGROUND OF THE INVENTION

Nowadays, light-emitting diode (LED) as a backlight source of mobile phones, televisions, computers, and other electronic devices, are more popular. In general, a LED module includes a number of LED strings, each LED string is corresponded to a certain display area and is used to illuminate the display area. However, because the characteristic, such as a resistance value of each LED exists difference, thus a current flowing through each LED string would be different even though a voltage applied to each LED string is the same, thereby causing luminance of light emitted by each LED string is different. Therefore, because the luminance of light emitted by each LED string is different, the luminance of the display of the electronic device is unbalanced, which affect the feel of a user, and it is need to adjust that problem.

SUMMARY OF THE INVENTION

The present invention provides a backlight adjustment circuit and an electronic device, which can adjust the luminance of each LED string of a LED module to a standard value.

An electronic device, comprising a light-emitting diode (LED) module and at least one backlight adjustment circuit, each backlight adjustment circuit is configured to detect the luminance of the light emitted by a corresponding one LED string and adjust the luminance correspondingly, each LED string comprises a plurality of LEDs and a current control resistor connected between a positive voltage port and ground in series; wherein, the backlight adjustment circuit comprises: a light sensing circuit, configured to sense the luminance of light emitted by one corresponding LED string and produces a corresponding light sensing signal value; a comparison unit, configured to compare the light sensing signal value produced by the light sensing circuit with a preset reference value, and produce a first signal when comparing the light sensing signal value is less than the preset reference value, and produce a second signal when comparing the light sensing signal value is greater than the preset reference value; and an adjustment unit, configured to control to decrease a current flowing through the LED string to decrease the luminance of the light emitted by the LED string, when receiving the first signal produced by the comparison unit; and to control to increase the current flowing through the LED string to increase the luminance of the light emitted by the LED string, when receiving the second signal produced by the comparison unit.

Therein, the light sensing circuit comprises a photoelectric converter and a voltage difference calculating unit, the photoelectric converter is located on an area where the LED string is, and is configured to sense the luminance of the light emitted by the LED string and produce corresponding first voltage and second voltage; the voltage difference calculating unit is configured to calculate a voltage difference of the first voltage and the second voltage according to the first voltage and the second voltage; the preset reference value is a reference voltage, the comparison unit compares the voltage difference of the first voltage and the second voltage with the reference voltage, and produces the first signal when comparing the voltage difference is less than the reference voltage, and produces the second signal when comparing the voltage difference is greater than the reference voltage.

Therein, the photoelectric converter comprises a photoresistor connected between a voltage port and ground, the photoresistor is located on an area where the corresponding LED string is, a voltage of the voltage port is divided on two terminals of the photoresistor and obtains the first voltage and the second voltage; therein, a voltage of a first terminal of the photoresistor is the first voltage, and a voltage of a second terminal of the photoresistor is the second voltage.

Therein, the voltage difference calculating unit comprises a first operational amplifier and a first resistor, a second resistor, a third resistor, and a fourth resistor with a same resistance value; an non-inverting input port of the first operational amplifier is electrically connected to the first terminal of the photoresistor via the first resistor, an inverting input port of the first operational amplifier is electrically connected to the second terminal of the photoresistor via the second resistor, the non-inverting input port of the first operational amplifier is also grounded via the third resistor, the inverting input port of the first operational amplifier is also connected to an output port of the first operational amplifier via the fourth resistor; the comparison unit is a comparator, an non-inverting input port of the comparator is connected to the output port of the first operational amplifier of the voltage difference calculating unit, an inverting input port of the comparator is connected to a reference voltage; the comparator outputs the first signal with a positive voltage when comparing the voltage difference of the first voltage and the second voltage output by the output port of the operational amplifier is greater than the reference voltage, the comparator outputs the second signal with a negative voltage when comparing the voltage difference of the first voltage and the second voltage is less than the reference voltage.

Therein, the adjustment unit comprises a second operational amplifier, a third operational amplifier, and a fifth resistor, a sixth resistor, a seventh resistor, a eighth resistor, and a ninth resistor; an output port of the third operational amplifier is connected to an away ground end of the current control resistor, and is configured to output a control voltage to the away ground end of the current control resistor to control the current flowing through the corresponding LED string; an inverting input port of the second operational amplifier is connected to the output port of the comparator via the fifth resistor, the inverting input port of the second operational amplifiers is further connected to a previous value of the control voltage via the sixth resistor; the inverting input port of the second operational amplifiers is further connected to an output port of the second operational amplifier via the seventh resistor; an non-inverting input port of the second operational amplifier is connected to an non-inverting input port of the third operational amplifier and is further grounded; an inverting input port of the third operational amplifier is electrically connected to the output port of the second operational amplifier via the eighth resistor, the inverting input port of the third operational amplifier is further connected to an output port of the third operational amplifier via the ninth resistor.

Therein, the light sensing circuit further comprises a voltage following unit connected between the photoelectric converter and the voltage difference calculating unit, the voltage following unit is configured to follow the first voltage and the second voltage output by the photoelectric converter, and output the followed first voltage and second voltage to the voltage difference calculating unit.

Therein, the voltage following unit comprises a fourth operational amplifier and a fifth operational amplifier, the fourth operational amplifiers is electrically connected between the first terminal of the photoresistor and the non-inverting input port of the first operational amplifiers, and is configured to transmit the first voltage of the first terminal of the photoresistor to the non-inverting input port of the first operational amplifiers; the fifth operational amplifiers is electrically connected between the second terminal of the photoresistor and the inverting input port of the first operational amplifiers, and is configured to transmit the second voltage of the second terminal of the photoresistor to the inverting input port of the first operational amplifiers.

Therein, the adjustment unit further comprises a delay circuit, and the previous value of the control voltage is obtained via the delay circuit.

Therein, the delay circuit comprises a first N-channel Metal Oxide Semiconductor Field Effect Transistor (NMOSFET), a second NMOSFET, and a storage capacitor; a source of the first NMOSFET is connected to the output port of the third operational amplifier and receives the control Vs output by the output port of the third operational amplifier, a drain of the first NMOSFET is connected to an end of the capacitor and is also connected to a drain of the second NMOSFET, a source of the second NMOSFET is configured to output the previous value of the control voltage; the other end of the capacitor is grounded; a gate of the first NMOSFET receives a first pulse-width modulating (PWM) signal, a gate of the second NMOSFET receives a second PWM signal, the first PWM signal is reversed to the second PWM signal.

An backlight adjustment circuit, configured to adjust luminance of light emitted by one light-emitting diode (LED) string of a LED module, the LED string comprises a plurality of LEDs and a current control resistor connected between a positive voltage port and ground in series; therein, the backlight adjustment circuit comprises: a light sensing circuit, configured to sense the luminance of light emitted by one corresponding LED string and produces a corresponding light sensing signal value; a comparison unit, configured to compare the light sensing signal value produced by the light sensing circuit with a preset reference value, and produce a first signal when comparing the light sensing signal value is less than the preset reference value, and produce a second signal when comparing the light sensing signal value is greater than the preset reference value; and an adjustment unit, configured to control to decrease a current flowing through the LED string to decrease the luminance of the light emitted by the LED string, when receiving the first signal produced by the comparison unit; and to control to increase the current flowing through the LED string to increase the luminance of the light emitted by the LED string, when receiving the second signal produced by the comparison unit.

Therein, the light sensing circuit comprises a photoelectric converter and a voltage difference calculating unit, the photoelectric converter is located on an area where the LED string is, and is configured to sense the luminance of the light emitted by the LED string and produce corresponding first voltage and second voltage; the voltage difference calculating unit is configured to calculate a voltage difference of the first voltage and the second voltage according to the first voltage and the second voltage; the preset reference value is a reference voltage, the comparison unit compares the voltage difference of the first voltage and the second voltage with the reference voltage, and produces the first signal when comparing the voltage difference is less than the reference voltage, and produces the second signal when comparing the voltage difference is greater than the reference voltage.

Therein, the photoelectric converter comprises a photoresistor connected between a voltage port and ground, the photoresistor is located on an area where the corresponding LED string is, a voltage of the voltage port is divided on two terminals of the photoresistor and obtains the first voltage and the second voltage; therein, a voltage of a first terminal of the photoresistor is the first voltage, and a voltage of a second terminal of the photoresistor is the second voltage.

Therein, the voltage difference calculating unit comprises a first operational amplifier and a first resistor, a second resistor, a third resistor, and a fourth resistor with a same resistance value; an non-inverting input port of the first operational amplifier is electrically connected to the first terminal of the photoresistor via the first resistor, an inverting input port of the first operational amplifier is electrically connected to the second terminal of the photoresistor via the second resistor, the non-inverting input port of the first operational amplifier is also grounded via the third resistor, the inverting input port of the first operational amplifier is also connected to an output port of the first operational amplifier via the fourth resistor; the comparison unit is a comparator, an non-inverting input port of the comparator is connected to the output port of the first operational amplifier of the voltage difference calculating unit, an inverting input port of the comparator is connected to a reference voltage; the comparator outputs the first signal with a positive voltage when comparing the voltage difference of the first voltage and the second voltage output by the output port of the operational amplifier is greater than the reference voltage, the comparator outputs the second signal with a negative voltage when comparing the voltage difference of the first voltage and the second voltage is less than the reference voltage.

Therein, the adjustment unit comprises a second operational amplifier, a third operational amplifier, and a fifth resistor, a sixth resistor, a seventh resistor, a eighth resistor, and a ninth resistor; an output port of the third operational amplifier is connected to an away ground end of the current control resistor, and is configured to output a control voltage to the away ground end of the current control resistor to control the current flowing through the corresponding LED string; an inverting input port of the second operational amplifier is connected to the output port of the comparator via the fifth resistor, the inverting input port of the second operational amplifiers is further connected to a previous value of the control voltage via the sixth resistor; the inverting input port of the second operational amplifiers is further connected to an output port of the second operational amplifier via the seventh resistor; an non-inverting input port of the second operational amplifier is connected to an non-inverting input port of the third operational amplifier and is further grounded; an inverting input port of the third operational amplifier is electrically connected to the output port of the second operational amplifier via the eighth resistor, the inverting input port of the third operational amplifier is further connected to an output port of the third operational amplifier via the ninth resistor.

Therein, the light sensing circuit further comprises a voltage following unit connected between the photoelectric converter and the voltage difference calculating unit, the voltage following unit is configured to follow the first voltage and the second voltage output by the photoelectric converter, and output the followed first voltage and second voltage to the voltage difference calculating unit.

Therein, the voltage following unit comprises a fourth operational amplifier and a fifth operational amplifier, the fourth operational amplifiers is electrically connected between the first terminal of the photoresistor and the non-inverting input port of the first operational amplifiers, and is configured to transmit the first voltage of the first terminal of the photoresistor to the non-inverting input port of the first operational amplifiers; the fifth operational amplifiers is electrically connected between the second terminal of the photoresistor and the inverting input port of the first operational amplifiers, and is configured to transmit the second voltage of the second terminal of the photoresistor to the inverting input port of the first operational amplifiers.

Therein, the adjustment unit further comprises a delay circuit, and the previous value of the control voltage is obtained via the delay circuit.

Therein, the delay circuit comprises a first N-channel Metal Oxide Semiconductor Field Effect Transistor (NMOSFET), a second NMOSFET, and a storage capacitor; a source of the first NMOSFET is connected to the output port of the third operational amplifier and receives the control Vs output by the output port of the third operational amplifier, a drain of the first NMOSFET is connected to an end of the capacitor and is also connected to a drain of the second NMOSFET, a source of the second NMOSFET is configured to output the previous value of the control voltage; the other end of the capacitor is grounded; a gate of the first NMOSFET receives a first pulse-width modulating (PWM) signal, a gate of the second NMOSFET receives a second PWM signal, the first PWM signal is reversed to the second PWM signal.

The backlight adjustment circuit and the electronic device of the present invention, can adjust the luminance of each LED string of a LED module to a standard value and make the luminance to be balanced.

DETAILED DESCRIPTION OF THE PREFERRED EMBODIMENTS

Figure 1:
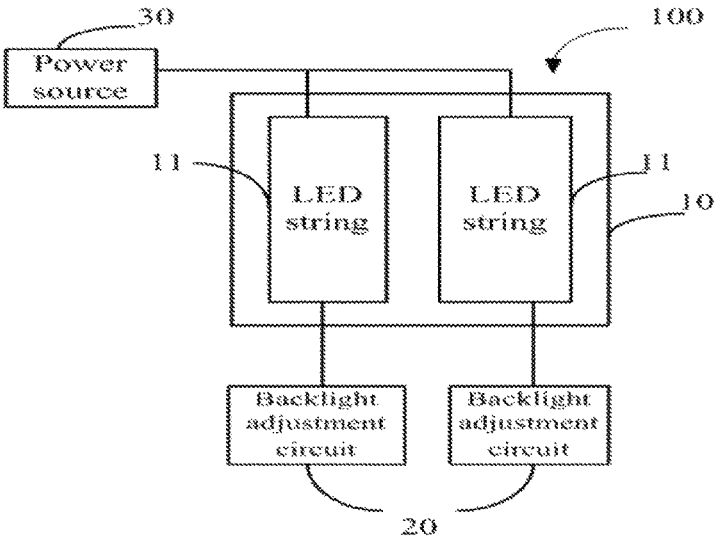
FIG. 1 illustrates a block diagram of an electronic device of an embodiment.
Figure 2:
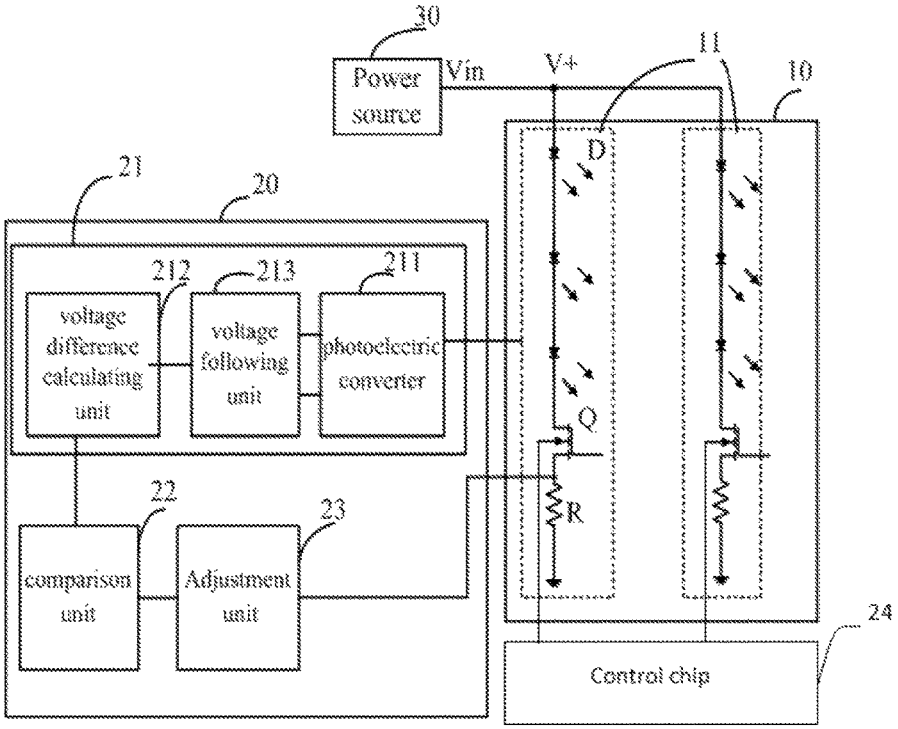
FIG. 2 illustrates a block diagram of a backlight adjustment circuit of an embodiment.

Referring to FIGS. 1 and 2, a block diagram of an electronic device 100 is illustrated. The electronic device 100 includes a light-emitting diode (LED) module 10 and at least one backlight adjustment circuit 20. The LED module 10 includes a number of LED strings 11, an amount of the backlight adjustment circuit 20 is equal to an amount of the LED strings 11, and each backlight adjustment circuit 20 is used to detect the luminance of the light emitted by a corresponding one LED string 11 and to adjust correspondingly. The electronic device 100 also includes a power source 30 used for providing power to the LED module 10. Therein, each LED string 11 provides backlight for one corresponding area of the electronic device 100.

As shown in FIG. 2, each backlight adjustment circuit 20 includes a light sensing circuit 21, a comparison unit 22, and an adjustment unit 23.

The light sensing circuit 21 is used to sense the luminance of light emitted by one corresponding LED string 11 and produces a corresponding light sensing signal value.

The comparison unit 22 is used to compare the light sensing signal value produced by the light sensing circuit 21 with a preset reference value, and produce a first signal when comparing the light sensing signal value is less than the preset reference value, and produce a second signal when comparing the light sensing signal value is greater than the preset reference value.

The adjustment unit 23 controls to decrease a current flowing through the LED string 11 to decrease the luminance of the light emitted by the LED string 11, when receiving the first signal produced by the comparison unit 22. The adjustment unit 23 also controls to increase the current flowing through the LED string 11 to increase the luminance of the light emitted by the LED string 11, when receiving the second signal produced by the comparison unit 22.

In detail, in the embodiment, the light sensing circuit 21 includes a photoelectric converter 211 and a voltage difference calculating unit 212. The photoelectric converter 211 is located on an area where the LED string 11 is, and is used to sense the luminance of the light emitted by the LED string 11 and produce a corresponding first voltage and second voltage. The voltage difference calculating unit 212 is used to calculate a voltage difference of the first voltage and the second voltage according to the first voltage and the second voltage. The voltage difference is the light sensing signal value.

In the embodiment, the preset reference value is a reference voltage, the comparison unit 22 compares the voltage difference of the first voltage and the second voltage with the reference voltage, and produces the first signal when comparing the voltage difference is less than the reference voltage, and produces the second signal when comparing the voltage difference is greater than the reference voltage.

In another embodiment, the light sensing circuit 21 can be a light sensor and is used to sense the luminance of light emitted by the corresponding LED string 11 and produces a corresponding light sensing signal.

As shown in FIG. 1, each LED string 11 includes a number of LEDs D and a current control resistor R connected between a positive voltage port V+ and ground in series. An end of the current control resistor R far away from the ground (hereinafter: the away ground end) is connected to the adjustment unit 23. The adjustment unit 23 outputs a corresponding voltage to the end of the current control resistor R far away from the ground, thus to control the current of the LED string 11. Therein, the adjustment unit 23 decrease the output voltage to decrease the current of the LED string 11 when receiving the first signal, thus decreasing the luminance of the light emitted by the LED string 11. The adjustment unit 23 increase the output voltage to increase the current of the LED string 11 when receiving the second signal, thus increasing the luminance of the light emitted by the LED string 11.

The reference voltage is a voltage difference value of the first voltage and the second voltage when the luminance of the LED string 11 is a standard value.

The light sensing circuit 21 also includes a voltage following unit 213, the voltage following unit 213 is connected between the photoelectric converter 211 and the voltage difference calculating unit 212, and is used to follow the first voltage and the second voltage output by the photoelectric converter 211, and output the followed first voltage and second voltage to the voltage difference calculating unit 212. According to the function of the voltage following unit 213, the voltage difference calculated by the comparison unit 22 is more exacted. Of course, in another embodiment, the voltage following unit 213 can be omitted.

Figure 3:
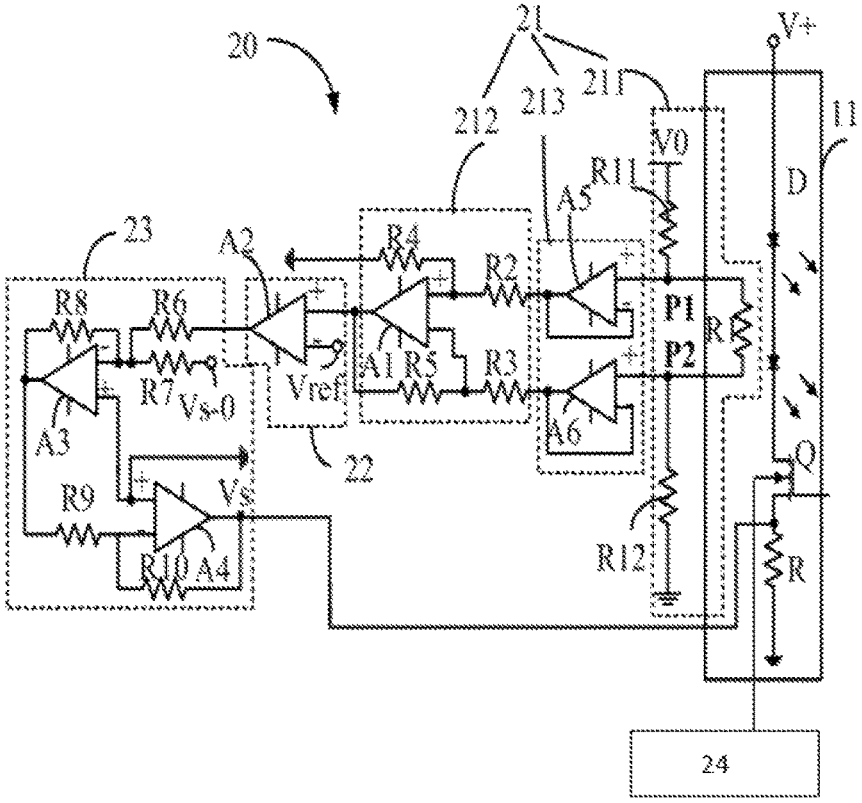
FIG. 3 illustrates a circuit diagram of a backlight adjustment circuit of an embodiment.

Referring to FIG. 3, an circuit diagram of the backlight adjustment circuit 20 is illustrated. The photoelectric converter 211 includes a photoresistor R1 connected between the voltage port V0 and ground. The photoresistor R1 is located on an area where the corresponding LED string 11 is. A resistance value of the photoresistor R1 is changed according to the luminance of the light emitted by the LED string 11. Thus, cause a voltage difference across the photoresistor R1 to be changed. A voltage of the voltage port V0 is divided on two terminals of the photoresistor R1 and obtains the first voltage and the second voltage. Therein, a voltage of a first terminal P1 of the photoresistor R1 is the first voltage, and a voltage of a second terminal P2 of the photoresistor R1 is the second voltage.

The voltage difference calculating unit 212 includes an operational amplifier A1 and resistors R2, R3, R4, and R5. An non-inverting input port (not shown) of the operational amplifier A1 is electrically connected to the first terminal P1 of the photoresistor R1 via the resistor R2, an inverting input port (not shown) of the operational amplifier A1 is electrically connected to the second terminal P2 of the photoresistor R1 via the resistor R3. The non-inverting input port of the operational amplifier A1 is also grounded via the resistor R4, the inverting input port of the operational amplifier A1 is also connected to an output port (not shown) of the operational amplifier A1 via the resistor R5.

In the embodiment, resistance values of the resistors R2-R5 are the same. Assume the first voltage is V1, the second voltage is V2, an output voltage of the operational amplifier A is V3. It is easily to know that V3=V1−V2 according to the attribute of the operational amplifier A. Thus, the output voltage output by the operational amplifier A is the voltage difference of the first voltage and the second voltage.

The comparison unit 22 is a comparator A2, an non-inverting input port (not shown) of the comparator A2 is connected to the output port of the operational amplifier A1 of the voltage difference calculating unit 212, an inverting input port (not shown) of the comparator A2 is connected to a reference voltage Vref. The comparator A2 outputs a positive voltage when comparing the output voltage of the output port of the operational amplifier A1, namely the voltage difference of the first voltage and the second voltage is greater than the reference voltage. The comparator A2 outputs a negative voltage when comparing the voltage difference of the first voltage and the second voltage is less than the reference voltage.

In the embodiment, the photoresistor R1 is a photoresistor with inverse proportional relationship, namely, the resistance value of the photosistor R1 is decreased when the luminance around the photosistor R1 is increased. The first signal is the negative voltage, and the second signal is the positive voltage. Therefore, when the luminance of the LED string 11 is increased, the resistance value of the photoresistor R1 is decreased, and the voltage difference of the first voltage and the second voltage is decreased too. When the voltage difference of the first voltage and the second voltage is decreased to a value less than the reference voltage, the comparator A2 outputs the first signal with the negative voltage. In the contrary, when the luminance of the LED string 11 is decreased, the resistance value of the photoresistor R1 is increased, and the voltage difference of the first voltage and the second voltage is increased too. When the voltage difference of the first voltage and the second voltage is increased to a value greater than the reference voltage, the comparator A2 outputs the second signal with the positive voltage.

The adjustment unit 23 includes an operational amplifiers A3, A4, and resistors R6, R7, R8, R9, and R10. An output port (not shown) of the operational amplifier A4 is connected to the away ground end of the current control resistor R, and is used to output a control voltage Vs to control the current flowing through the LED string 11.

An inverting input port (not shown) of the operational amplifier A3 is connected to the output port of the comparator A2 via the resistor R6, the inverting input port of the operational amplifiers A3 is also connected to a previous value Vs−0 of the control voltage Vs via the resistor R7; the inverting input port of the operational amplifiers A3 is further connected to an output port of the operational amplifier A3 via the resistor R8. An non-inverting input port (not shown) of the operational amplifier A3 is connected to an non-inverting input port (not shown) of the operational amplifier A4 and is also grounded. An inverting input port (not shown) of the operational amplifier A4 is electrically connected to the output port of the operational amplifier A3 via the resistor R9, the inverting input port of the operational amplifier A4 is also connected to an output port (not shown) of the operational amplifier A4 via the resistor R10.

Therefore, when the comparator A2 outputs the negative voltage, the previous value Vs−0 of the control voltage Vs applied on the inverting input port of the operational amplifiers A3 is attenuated due to the attribute of the operational amplifier A3, thus the current flowing through the resistors R8, R9, and R10 is decreased. Assume the current flowing through the resistor R10 is I, therefore, the control voltage Vs output by the operational amplifier A4 is Vs=I*R10, which is decreased also, therefore, the voltage output to the away ground end of the current control resistor R is decreased and cause the current flowing through the LED string 11 to decrease, thus decreasing the luminance of the light emitted by the LED string 11.

When the comparator A2 outputs the positive voltage, according to the attribute of the comparator A2, the previous value Vs−0 of the control voltage Vs applied on the inverting input port of the operational amplifiers A3 is enhanced, thus the current flowing through the resistors R8, R9, and R10 is increased. Similarly, the control voltage Vs output by the operational amplifier A4 is Vs=I*R10, which is increased also. Therefore, the voltage output to the away ground end of the current control resistor R is increased and cause the current flowing through the LED string 11 to increase, thus increasing the luminance of the light emitted by the LED string 11.

In the embodiment, a resistance value of the resistor R6 is equal to that of the resistor R8, and is less than a resistance value of the resistor R7. Namely, R7>R6=R8. Thus making the control voltage Vs to increase or decrease slowly.

Figure 4:
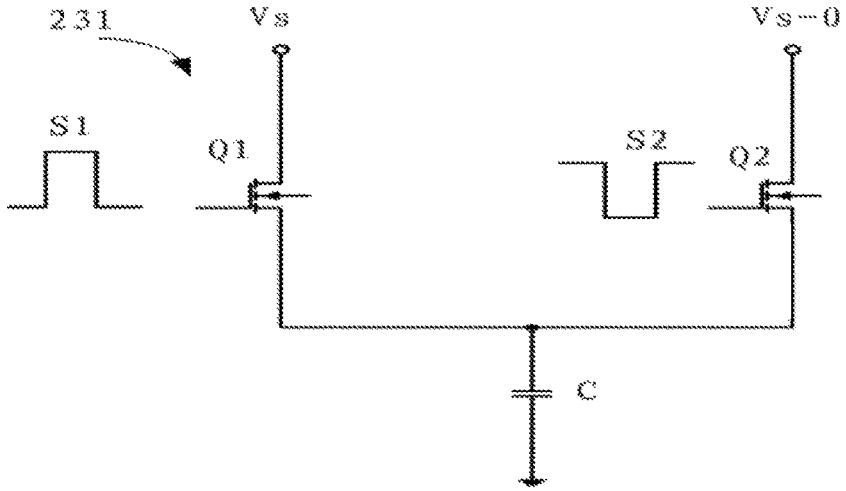
FIG. 4 illustrates schematic diagram of a delay circuit of the backlight adjustment circuit of FIG. 3 of an embodiment.

Referring to FIG. 4 together, the adjustment unit 23 also includes a delay circuit 231. Therein, the previous value Vs−0 of the control voltage Vs is obtained via the delay circuit 231. In detail, the delay circuit 231 includes a N-channel Metal Oxide Semiconductor Field Effect Transistor (NMOSFET) Q1, a NMOSFET Q2, and a storage capacitor C. A source of the NMOSFET Q1 is connected to the output port of the operational amplifier A4 and receives the control voltage Vs output by the output port of the operational amplifier A4. A drain of the NMOSFET Q1 is connected to an end of the capacitor C and is also connected to a drain of the NMOSFET Q2. A source of the NMOSFET Q2 is used to output the previous value Vs−0 of the control voltage Vs. The other end of the capacitor C is grounded. Therein, a gate of the NMOSFET Q1 receives a first pulse-width modulating (PWM) signal S1, a gate of the NMOSFET Q2 receives a second PWM signal S2, the first PWM signal S1 is reversed to the second PWM signal S2. Therefore, when the first PWM signal S1 is at high voltage, the NMOSFET Q1 is turned on, the control voltage Vs charges the capacitor C via the NMOSFET Q1 and is stored in the capacitor C. At a next time, when the NMOSFET Q1 is turned off, and the NMOSFET Q2 is turned on, and obtains the previous value Vs−0 of the control voltage Vs from the capacitor C.

The first PWM signal S1 and the second PWM signal S2 can be output by a control chip.

The backlight driving circuit 20 can be embedded in a LED driving chip.

Therein, each LED string 11 also includes a NMOSFET Q, the NMOSFET Q is turned on or off according corresponding control signals received by it, thus cause the LED string to emit light or stops emitting light.

In another embodiments, the NMOSFET Q1, Q2, Q can be instead by negative-positive-negative bipolar junction transistors.

Therein, the photoelectric converter 211 also a resistor R11 connected between the first terminal P1 of the photoresistor R1 and the voltage port V0 and a resistor R12 connected between the second terminal P2 of the photoresistor R1 and the ground.

Therein, the voltage following unit 213 includes operational amplifiers A5, A6. The operational amplifiers A5 is electrically connected between the first terminal P1 of the photoresistor R1 and the non-inverting input port of the operational amplifiers A1, and is used to transmit the first voltage of the first terminal P1 of the photoresistor R1 to the non-inverting input port of the operational amplifiers A1. The operational amplifiers A6 is electrically connected between the second terminal P2 of the photoresistor R1 and the inverting input port of the operational amplifiers A1, and is used to transmit the second voltage of the second terminal P2 of the photoresistor R1 to the inverting input port of the operational amplifiers A1.

The electronic device 100 can be a mobile phone, a tablet computer, a display, a television, and the like.

The present invention may be embodied in other forms without departing from the spirit or novel characteristics thereof. The embodiments disclosed in this application are to be considered in all respects as illustrative and not limitative. The scope of the invention is indicated by the appended claims rather than by the foregoing description; and all changes which come within the meaning and range of equivalency of the claims are intended to be embraced therein.

What is claimed is:

1. An electronic device, comprising a light-emitting diode (LED) module and at least one backlight adjustment circuit, each backlight adjustment circuit is configured to detect the luminance of the light emitted by a corresponding one LED string and adjust the luminance correspondingly, each LED string comprises a plurality of LEDs and a current control resistor connected between a positive voltage port and ground in series; wherein, the backlight adjustment circuit comprises:

a light sensing circuit, configured to sense the luminance of light emitted by one corresponding LED string and produces a corresponding light sensing signal value;

a comparison unit, configured to compare the light sensing signal value produced by the light sensing circuit with a preset reference value, and produce a first signal when comparing the light sensing signal value is less than the preset reference value, and produce a second signal when comparing the light sensing signal value is greater than the preset reference value; and an adjustment unit, configured to control to decrease a current flowing through the LED string to decrease the luminance of the light emitted by the LED string, when receiving the first signal produced by the comparison unit; and to control to increase the current flowing through the LED string to increase the luminance of the light emitted by the LED string, when receiving the second signal produced by the comparison unit;

wherein the light sensing circuit comprises a photoelectric converter and a voltage difference calculating unit, the photoelectric converter is located on an area where the LED string is, and is configured to sense the luminance of the light emitted by the LED string and produce corresponding first voltage and second voltage; the voltage difference calculating unit is configured to calculate a voltage difference of the first voltage and the second voltage according to the first voltage and the second voltage; the preset reference value is a reference voltage, the comparison unit compares the voltage difference of the first voltage and the second voltage with the reference voltage, and produces the first signal when comparing the voltage difference is less than the reference voltage, and produces the second signal when comparing the voltage difference is greater than the reference voltage.

2. The electronic device of claim 1, wherein the photoelectric converter comprises a photoresistor connected between a voltage port and ground, the photoresistor is located on an area where the corresponding LED string is, a voltage of the voltage port is divided on two terminals of the photoresistor and obtains the first voltage and the second voltage; wherein, a voltage of a first terminal of the photoresistor is the first voltage, and a voltage of a second terminal of the photoresistor is the second voltage.

3. The electronic device of claim 2, wherein the voltage difference calculating unit comprises a first operational amplifier and a first resistor, a second resistor, a third resistor, and a fourth resistor with a same resistance value; an non-inverting input port of the first operational amplifier is electrically connected to the first terminal of the photoresistor via the first resistor, an inverting input port of the first operational amplifier is electrically connected to the second terminal of the photoresistor via the second resistor, the non-inverting input port of the first operational amplifier is also grounded via the third resistor, the inverting input port of the first operational amplifier is also connected to an output port of the first operational amplifier via the fourth resistor; the comparison unit is a comparator, an non-inverting input port of the comparator is connected to the output port of the first operational amplifier of the voltage difference calculating unit, an inverting input port of the comparator is connected to a reference voltage; the comparator outputs the first signal with a positive voltage when comparing the voltage difference of the first voltage and the second voltage output by the output port of the operational amplifier is greater than the reference voltage, the comparator outputs the second signal with a negative voltage when comparing the voltage difference of the first voltage and the second voltage is less than the reference voltage.

4. The electronic device of claim 3, wherein the light sensing circuit further comprises a voltage following unit connected between the photoelectric converter and the voltage difference calculating unit, the voltage following unit is configured to follow the first voltage and the second voltage output by the photoelectric converter, and output the followed first voltage and second voltage to the voltage difference calculating unit.

5. The electronic device of claim 4, wherein the voltage following unit comprises a fourth operational amplifier and a fifth operational amplifier, the fourth operational amplifiers is electrically connected between the first terminal of the photoresistor and the non-inverting input port of the first operational amplifiers, and is configured to transmit the first voltage of the first terminal of the photoresistor to the non-inverting input port of the first operational amplifiers; the fifth operational amplifiers is electrically connected between the second terminal of the photoresistor and the inverting input port of the first operational amplifiers, and is configured to transmit the second voltage of the second terminal of the photoresistor to the inverting input port of the first operational amplifiers.

6. The electronic device of claim 3, wherein the adjustment unit comprises a second operational amplifier, a third operational amplifier, and a fifth resistor, a sixth resistor, a seventh resistor, a eighth resistor, and a ninth resistor, an output port of the third operational amplifier is connected to an away ground end of the current control resistor, and is configured to output a control voltage to the away ground end of the current control resistor to control the current flowing through the corresponding LED string; an inverting input port of the second operational amplifier is connected to the output port of the comparator via the fifth resistor, the inverting input port of the second operational amplifiers is further connected to a previous value of the control voltage via the sixth resistor, the inverting input port of the second operational amplifiers is further connected to an output port of the second operational amplifier via the seventh resistor; an non-inverting input port of the second operational amplifier is connected to an non-inverting input port of the third operational amplifier and is further grounded; an inverting input port of the third operational amplifier is electrically connected to the output port of the second operational amplifier via the eighth resistor, the inverting input port of the third operational amplifier is further connected to an output port of the third operational amplifier via the ninth resistor.

7. The electronic device of claim 6, wherein the adjustment unit further comprises a delay circuit, and the previous value of the control voltage is obtained via the delay circuit.

8. The electronic device of claim 7, wherein the delay circuit comprises a first N-channel Metal Oxide Semiconductor Field Effect Transistor (NMOSFET), a second NMOSFET, and a storage capacitor; a source of the first NMOSFET is connected to the output port of the third operational amplifier and receives the control Vs output by the output port of the third operational amplifier, a drain of the first NMOSFET is connected to an end of the capacitor and is also connected to a drain of the second NMOSFET, a source of the second NMOSFET is configured to output the previous value of the control voltage; the other end of the capacitor is grounded: a gate of the first NMOSFET receives a first pulse-width modulating (PWM) signal, a gate of the second NMOSFET receives a second PWM signal, the first PWM signal is reversed to the second PWM signal.

9. An backlight adjustment circuit, configured to adjust luminance of light emitted by one light-emitting diode (LED) string of a LED module, the LED string comprises a plurality of LEDs and a current control resistor connected between a positive voltage port and ground in series; wherein, the backlight adjustment circuit comprises:

a light sensing circuit, configured to sense the luminance of light emitted by one corresponding LED string and produces a corresponding light sensing signal value;

a comparison unit, configured to compare the light sensing signal value produced by the light sensing circuit with a preset reference value, and produce a first signal when comparing the light sensing signal value is less than the preset reference value, and produce a second signal when comparing the light sensing signal value is greater than the preset reference value; and an adjustment unit, configured to control to decrease a current flowing through the LED string to decrease the luminance of the light emitted by the LED string, when receiving the first signal produced by the comparison unit; and to control to increase the current flowing through the LED string to increase the luminance of the light emitted by the LED string, when receiving the second signal produced by the comparison unit;

wherein the light sensing circuit comprises a photoelectric converter and a voltage difference calculating unit, the photoelectric converter is located on an area where the LED string is, and is configured to sense the luminance of the light emitted by the LED string and produce corresponding first voltage and second voltage; the voltage difference calculating unit is configured to calculate a voltage difference of the first voltage and the second voltage according to the first voltage and the second voltage; the preset reference value is a reference voltage, the comparison unit compares the voltage difference of the first voltage and the second voltage with the reference voltage, and produces the first signal when comparing the voltage difference is less than the reference voltage, and produces the second signal when comparing the voltage difference is greater than the reference voltage.

10. The backlight adjustment circuit of claim 9, wherein the photoelectric converter comprises a photoresistor connected between a voltage port and ground, the photoresistor is located on an area where the corresponding LED string is, a voltage of the voltage port is divided on two terminals of the photoresistor and obtains the first voltage and the second voltage; wherein, a voltage of a first terminal of the photoresistor is the first voltage, and a voltage of a second terminal of the photoresistor is the second voltage.

11. The backlight adjustment circuit of claim 10, wherein the voltage difference calculating unit comprises a first operational amplifier and a first resistor, a second resistor, a third resistor, and a fourth resistor with a same resistance value; an non-inverting input port of the first operational amplifier is electrically connected to the first terminal of the photoresistor via the first resistor, an inverting input port of the first operational amplifier is electrically connected to the second terminal of the photoresistor via the second resistor, the non-inverting input port of the first operational amplifier is also grounded via the third resistor, the inverting input port of the first operational amplifier is also connected to an output port of the first operational amplifier via the fourth resistor; the comparison unit is a comparator, an non-inverting input port of the comparator is connected to the output port of the first operational amplifier of the voltage difference calculating unit, an inverting input port of the comparator is connected to a reference voltage: the comparator outputs the first signal with a positive voltage when comparing the voltage difference of the first voltage and the second voltage output by the output port of the operational amplifier is greater than the reference voltage, the comparator outputs the second signal with a negative voltage when comparing the voltage difference of the first voltage and the second voltage is less than the reference voltage.

12. The backlight adjustment circuit of claim 11, wherein the light sensing circuit further comprises a voltage following unit connected between the photoelectric converter and the voltage difference calculating unit, the voltage following unit is configured to follow the first voltage and the second voltage output by the photoelectric converter, and output the followed first voltage and second voltage to the voltage difference calculating unit.

13. The backlight adjustment circuit of claim 12, wherein the voltage following unit comprises a fourth operational amplifier and a fifth operational amplifier, the fourth operational amplifiers is electrically connected between the first terminal of the photoresistor and the non-inverting input port of the first operational amplifiers, and is configured to transmit the first voltage of the first terminal of the photoresistor to the non-inverting input port of the first operational amplifiers; the fifth operational amplifiers is electrically connected between the second terminal of the photoresistor and the inverting input port of the first operational amplifiers, and is configured to transmit the second voltage of the second terminal of the photoresistor to the inverting input port of the first operational amplifiers.

14. The backlight adjustment circuit of claim 11, wherein the adjustment unit comprises a second operational amplifier, a third operational amplifier, and a fifth resistor, a sixth resistor, a seventh resistor, a eighth resistor, and a ninth resistor; an output port of the third operational amplifier is connected to an away ground end of the current control resistor, and is configured to output a control voltage to the away ground end of the current control resistor to control the current flowing through the corresponding LED string; an inverting input port of the second operational amplifier is connected to the output port of the comparator via the fifth resistor, the inverting input port of the second operational amplifiers is further connected to a previous value of the control voltage via the sixth resistor; the inverting input port of the second operational amplifiers is further connected to an output port of the second operational amplifier via the seventh resistor, an non-inverting input port of the second operational amplifier is connected to an non-inverting input port of the third operational amplifier and is further grounded; an inverting input port of the third operational amplifier is electrically connected to the output port of the second operational amplifier via the eighth resistor, the inverting input port of the third operational amplifier is further connected to an output port of the third operational amplifier via the ninth resistor.

15. The backlight adjustment circuit of claim 14, wherein the adjustment unit further comprises a delay circuit, and the previous value of the control voltage is obtained via the delay circuit.

16. The backlight adjustment circuit of claim 15, wherein the delay circuit comprises a first N-channel Metal Oxide Semiconductor Field Effect Transistor (NMOSFET), a second NMOSFET, and a storage capacitor; a source of the first NMOSFET is connected to the output port of the third operational amplifier and receives the control Vs output by the output port of the third operational amplifier, a drain of the first NMOSFET is connected to an end of the capacitor and is also connected to a drain of the second NMOSFET, a source of the second NMOSFET is configured to output the previous value of the control voltage; the other end of the capacitor is grounded; a gate of the first NMOSFET receives a first pulse-width modulating (PWM) signal, a gate of the second NMOSFET receives a second PWM signal, the first PWM signal is reversed to the second PWM signal.

* * * * *